United States Patent [19]

Benoit

[11] Patent Number: 4,621,395

[45] Date of Patent: Nov. 11, 1986

[54] CASKET HARDWARE FOR ADJUSTING COFFIN BEDS

[75] Inventor: Roland Benoit, Danielson, Conn.

[73] Assignee: Gem Industries, Inc., Gardner, Mass.

[21] Appl. No.: 686,417

[22] Filed: Dec. 26, 1984

[51] Int. Cl.[4] ..... A61G 17/04; A61G 17/00

[52] U.S. Cl. ..... 27/12; 403/339; 5/63

[58] Field of Search ..... 27/12, 27, 28; 403/346, 403/347, 399; 5/11, 63–65

[56] References Cited

U.S. PATENT DOCUMENTS

| | | | |
|---|---|---|---|
| 368,459 | 8/1887 | Clow | 403/346 |
| 615,838 | 12/1898 | Foster | 5/11 |
| 2,303,269 | 11/1942 | Goss | 403/399 |
| 3,065,516 | 11/1962 | Dower | 27/12 |
| 3,539,142 | 11/1970 | Morand | 27/12 |
| 3,692,267 | 9/1972 | Kronas et al. | 27/12 |
| 4,070,737 | 1/1978 | Peterson | 27/12 |
| 4,403,380 | 9/1983 | Hazelett et al. | 27/12 |
| 4,404,716 | 9/1983 | Foust | 27/12 |

*Primary Examiner*—Robert A. Hafer
*Assistant Examiner*—Terrence L. B. Brown
*Attorney, Agent, or Firm*—Charles R. Fay

[57] ABSTRACT

Casket hardware for supporting and adjusting a body supporting spring frame comprising a screw, a barcket engaged with the screw to travel along it, and a part of the spring frame engaged with the bracket and being held to the bracket in part by the screw.

14 Claims, 10 Drawing Figures

CASKET HARDWARE FOR ADJUSTING COFFIN BEDS

FIELD OF THE INVENTION

Adjustable support for the body supporting spring frame in a casket.

BACKGROUND OF THE INVENTION

Adjustable supports for the body support spring frame in a casket have long been used to tilt the spring frame about, e.g. a transverse axis, for better display. These supports have been in the main expensive and take some time and trouble to assemble. The prior art hardware has been relatively expensive and cumbersome. Correction of these deficiencies has been found to be desirable. The present invention greatly changes the construction over the prior art, and the changes are far greater in kind than simple cheapening of the parts. The casket is unchanged and the body support spring frame is provided with only a slight modification.

SUMMARY OF THE INVENTION

Improved brackets for top and bottom ends of the adjusting screw, as well as improved novel nylon bushings, are provided for ease in use and assembly as well as improved smoothness and quietness in operation, but the screw per se is not changed to a great degree and is turned as in the prior art to raise or lower the body supporting spring frame at each end thereof. The brackets for the screw are mounted on the casket bottom and head and foot of the basket upper edge by welding or screws, as deemed appropriate. These brackets are changed to accommodate the novel bushings which are secured to the screw at its ends and turn with the screw to accomplish the adjustment. The lower bushing is in the nature of a thrust bearing, and the upper bushing has a lower recess to cap the screw and an upper recessed projection that extends through the upper bracket to receive and be rotated by a separable crank. The projection snaps into an opening in the upper bushing and is completely surrounded and encompassed thereby. Once the desired adjustment is made, the parts are not intended to be reset.

The body support spring is made up as usual of four angle irons, one at each of head and foot connected by side or edge irons in a rectangular frame for the spring fabric taking up the spring frame opening. A spring frame bracket of deep U-shape is provided for each end angle (head and foot). Each spring frame bracket is slid over its respective iron and the screw is threaded through corresponding threaded openings in the arms of the U-shaped brackets. These openings are closely adjacent the open ends of the U-shaped brackets and the angle irons are located in the U's between the closed ends thereof and their screws. The screws are in fixed locations relative to the ends of the casket but the U-shaped brackets provide for the accommodation of various length spring frames because the end angle irons are relatively slidable in the U brackets.

In addition, each end angle iron has horizontal and vertical portions that have a certain definite width relative to the distance between the arms of the U-brackets, the arms of which are plane, parallel and of course spaced. The head and foot irons, the end irons of the frame, each has a shallow recess in the center thereof at the free edge of the vertical portion thereof, and one arm, the upper one, of the respective U-bracket is located in this recess. The arm of the U-bracket is the same width as the length of the recess and has a shape or contour to just slidably receive the respective arm. The distance between arms is equal to the dimension from the bottom of the recess to the outer surface of the horizontal portion of the angle iron. Thus the U-bracket is centered on the frame while being relatively slidable thereon parallel to the width of the horizontal portion of the angle iron, and the parts retain their relation.

The head and foot angle irons also are recessed at the free edges of the horizontal portions thereof in conformance with the recesses in the free edges of the vertical portions. This is to allow the U-brackets and assembled screws to be located at right angles to the operative position thereof, for shipping and storage, if desired. In operative position, the screw is parallel to the vertical portions of the angle irons of the spring frame and the U-brackets are parallel to the horizontal portions thereof, but because of the recesses in the latter, the U-brackets can be turned 90° and depend from the spring frame, with the screws under the spring frame, parallel thereto.

PREFERRED EMBODIMENT OF THE INVENTION

Figure 1:
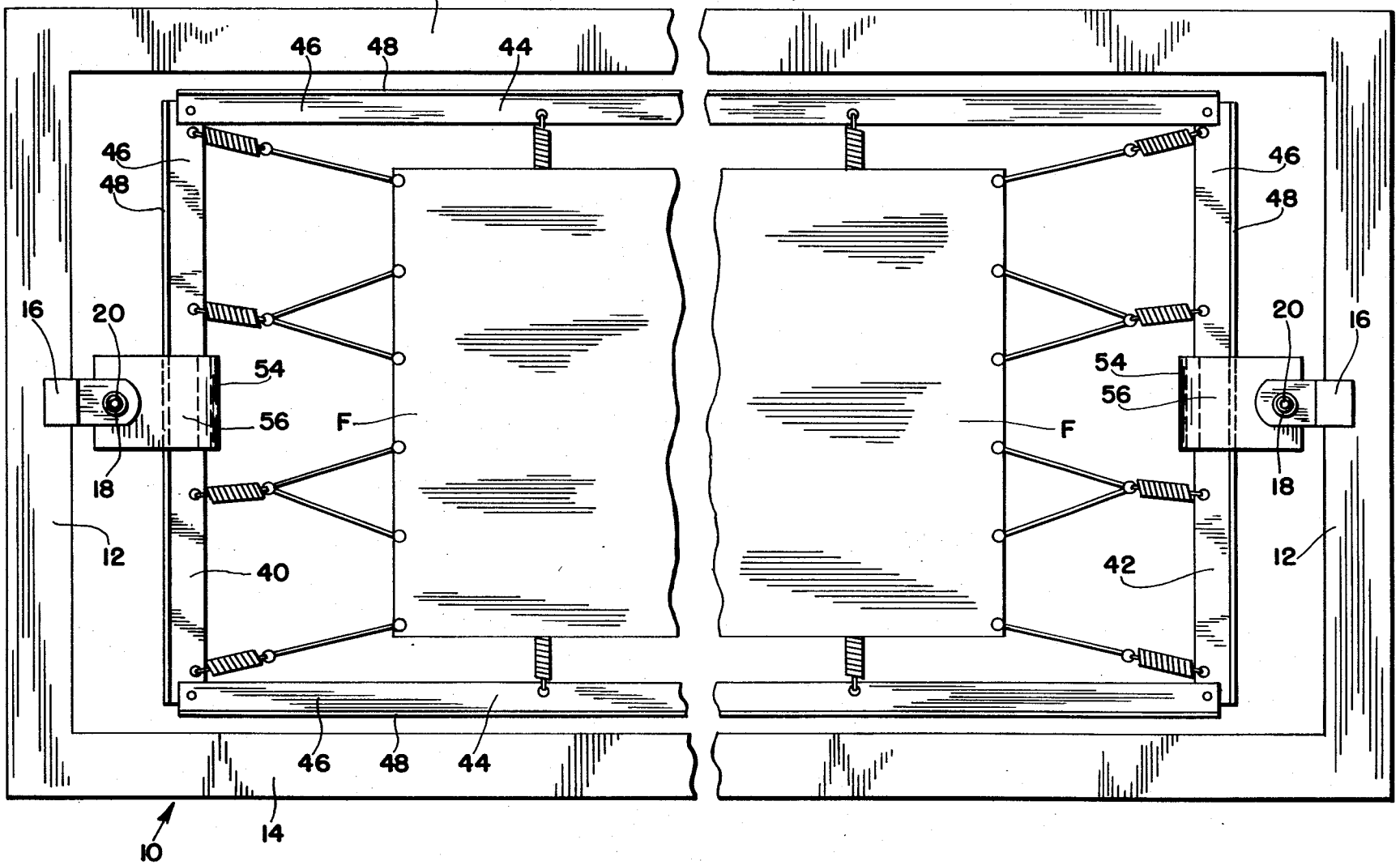
FIG. 1 is a top plan view of an open casket, showing the invention, part cut away.

This invention is illustrated as applied to a conventional steel casket but it can be applied to a wooden casket, or caskets of any suitable material as well, simply by applying certain brackets and the like by screws as will appear hereinafter. The casket herein is partially outlined in FIG. 2 but will be familiar in toto to those knowlegeable in the art. In any event, the casket has a ledge 10 at and defining the top opening thereof, this ledge including end parts 12 and side parts 14. The end ledges 12 are provided with inboard flat, pressed metal brackets 16 apertured to snap receive nylon socket bushing 18. This bushing has opposite, separate, spaced recess 20 and 22, recess 20 being adapted to receive a separable crank to turn the bushing in its opening in bracket 16 and recess 22 receiving an end of an operating screw 24 fixed to the bushing by a set of screws 26.

Figure 2:
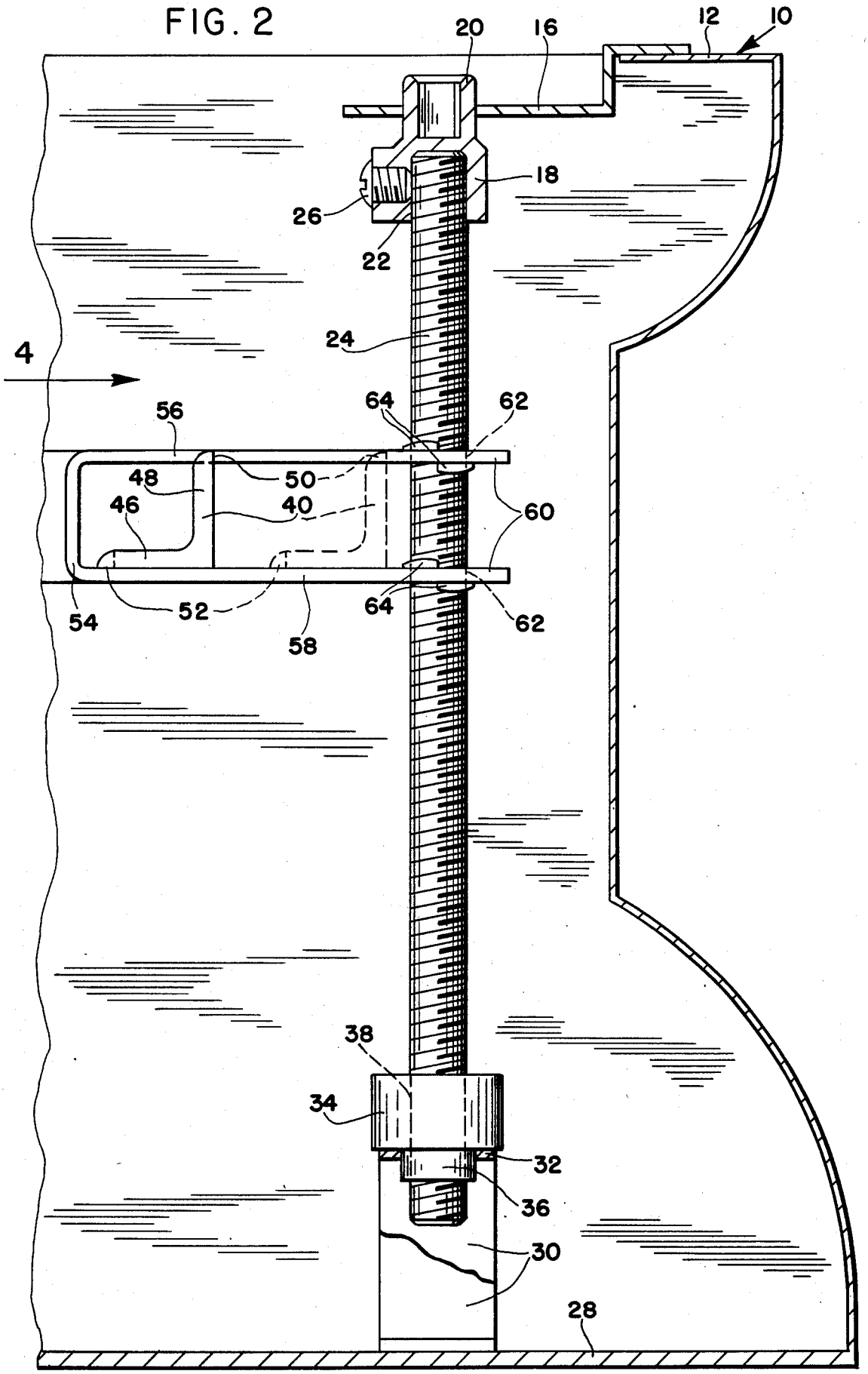
FIG. 2 is a view in elevation, partly in section, showing the screw, U-shaped bracket, and related parts.

The bottom of the casket 28 in FIG. 2 has mounted thereon a pressed metal two-legged bracket 30 of U or V-shape having a raised flat top 32 with an opening in it to receive another but different nylon bushing 34 with a central barrel 36 lodged in the opening and a top recess 38 receiving the lower end of the screw 24. The bushing 34 is preferably secured to the screw by a set screw so that the bushing turns on bracket 30.

Figure 8:
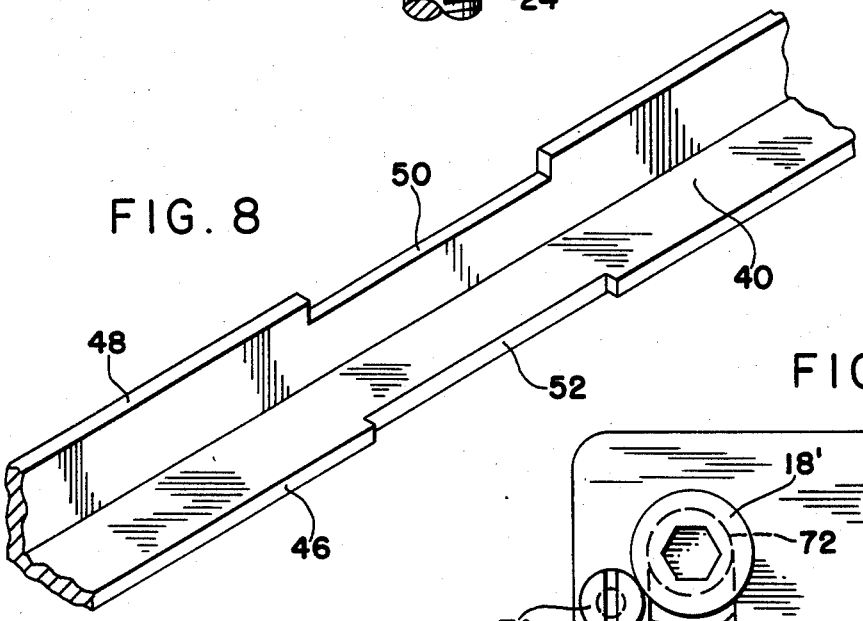
FIG. 8 is a perspective view of an end angle iron of the body supporting frame.

The body supporting spring frame is made of four angle irons, one at each end connected by side members 44, 44. Each angle iron has a horizontal part (flange) 46 and a vertical part (flange) 48 and they are secured into rectangular shape of the ends of the horizontal parts that overlap. The fabric F of the spring is conventional. The end iron 40 (and 42) is provided with recesses 50 and 52 in the free edges of vertical part 48 and horizontal part 46, see FIG. 8. These recesses are alike in depth and length and are placed similarly in the centers of the respective angle iron parts. Also, they equal the width of a U-shaped bracket 54 and correspond in depth to the thickness of the arms 56 and 58 which are flat, parallel and spaced. The total height of the angle iron equals the distance from the inner or upper aspect of horizontal part 46 to the free edge of the vertical part 48, see FIG. 2, and the parts 46 and 48 are just alike. Thus, the end iron 40, e.g. can slide between the solid line and the dotted line positions, in bracket 54, the bracket being locked to the angle iron longitudinally of the latter.

The bracket 54 thus straddles the angle iron 40 and at the open side or edge portion of the bracket as at 60 there are corresponding aligned openings 62 to admit screw 24, FIG. 2. These openings each have one screw thread or equivalent, made by pressing, as at 64.

Figure 3:
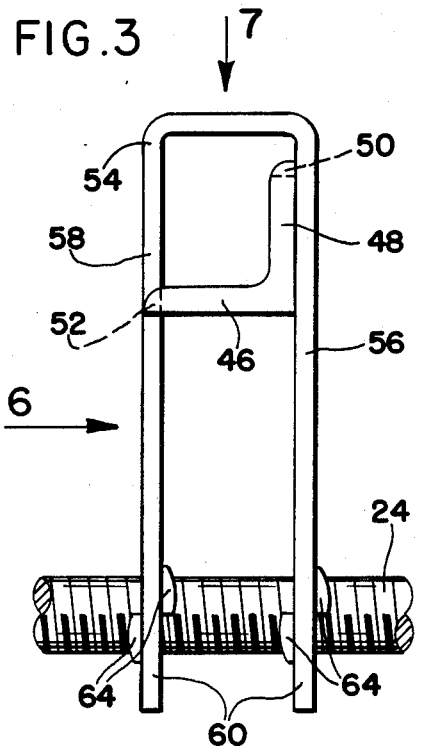
FIG. 3 is a view similar to FIG. 2 but showing the screw and U-shaped bracket in a different relation to the respective frame angle iron, and omitting several parts.
Figure 4:
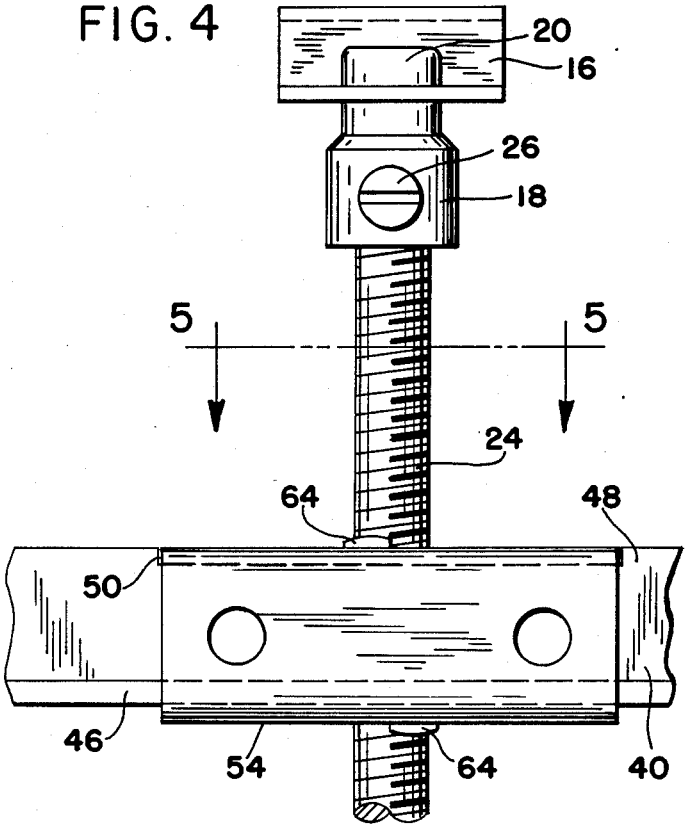
FIG. 4 is an elevational view of the screw, and its U-shape bracket looking in the direction of arrow 4 in FIG. 2.
Figure 10:
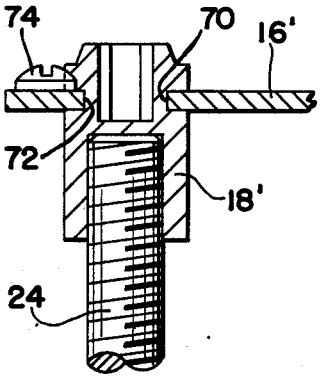
FIG. 10 is a sectional view of a modified crank socket for the modified bracket of FIG. 9.
Figure 5:
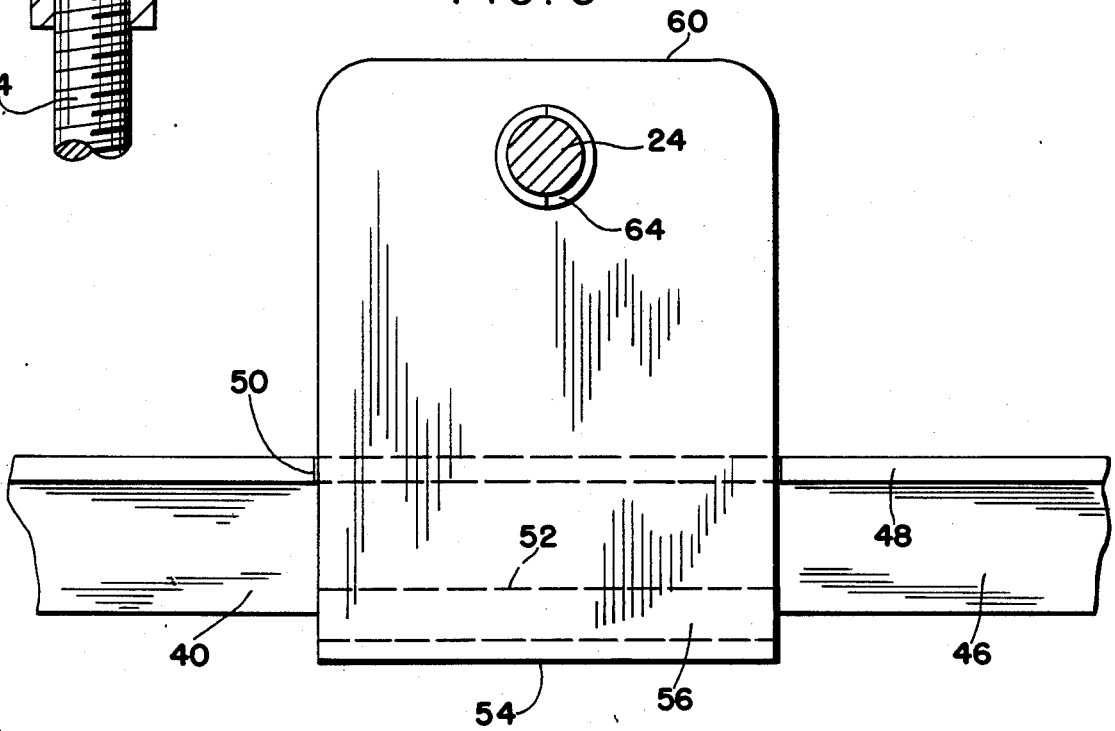
FIG. 5 is a sectional view on Line 5—5 of FIG. 4.
Figure 6:
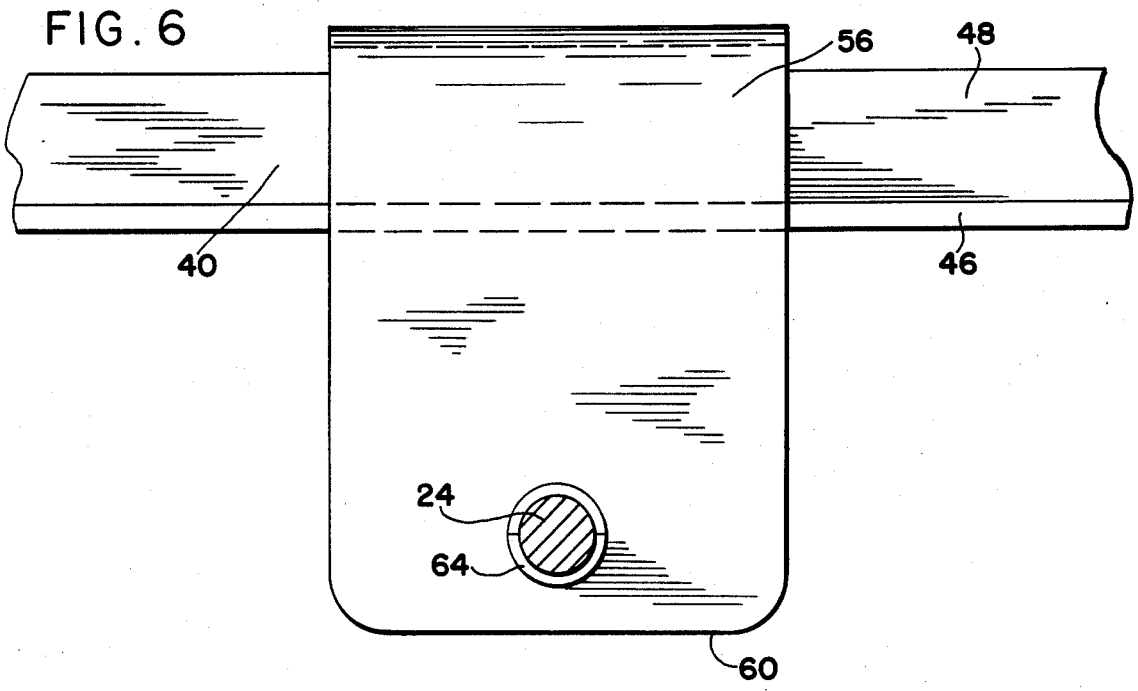
FIG. 6 is an elevational view looking in the direction of arrow 6 in FIG. 3.
Figure 7:
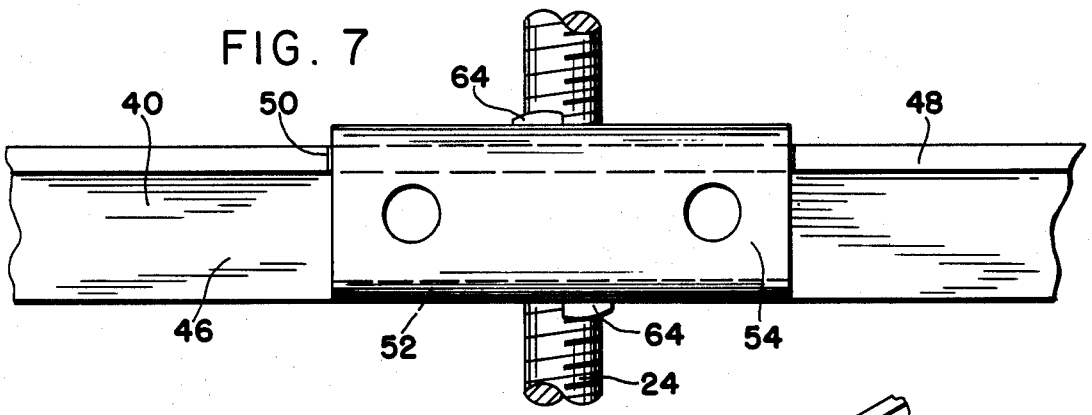
FIG. 7 is a plan view looking in the direction of arrow 7 in FIG. 3.
Figure 9:
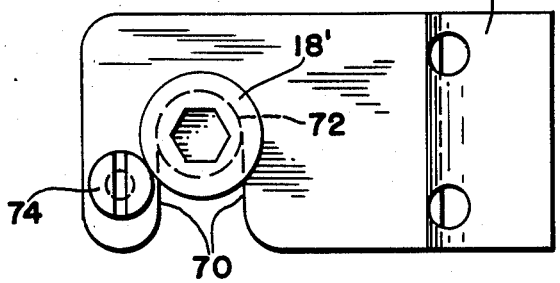
FIG. 9 is a plan view of a modified top bracket for the screw.

For shipment and storage, the bracket 54 and attached screw 24 can be swung into the FIG. 3 position wherein arm 58 of bracket 54 enters notch 52 in horizontal part 46 of the angle iron, and the screw can be assembled with the bushings 18 and 34 on site.

Where it is difficult to assemble the upper end of the screw 24 and its crank socket or bushing 18, the alternative bracket 16' of FIGS. 9 and 10 may be used. This bracket has a side or edge opening 70 receiving socket bushing 18' sideways, the latter preferably having an annular notch 72 to hold it vertically in the bracket 16', and an oversize screw head 74 may be applied to hold the bushing against escape out of the opening 70 horizontally.

I claim:

1. Casket hardware comprising a body supporting fixed frame, fixed means to support the frame, means to adjust the supporting means to vary the vertical position of at least a part of the frame said adjusting means comprising a screw, means to rotate the screw, means to hold the screw in fixed position, a bracket, means on the bracket to engage the screw so that the bracket is translated along the screw as the screw is rotated, said bracket engaging and securing a part of the frame whereby the frame part is translated with the bracket, said bracket having a generally U-shape including a closed end, said closed end being spaced from the screw, the frame part being captured in the bracket between the screw and the closed end of the bracket, thereby substantially locking the bracket and frame part together, the bracket comprising a guide for captively guided motion of the frame part in one direction relative to the bracket, the screw limiting said frame motion in said direction, and the bracket preventing relative motion of frame and bracket in a direction parallel to the screw.

2. The casket hardware of claim 1 wherein said guide includes a recess accommodating a part only of the bracket.

3. The casket hardware of claim 2 wherein the frame part is an angle iron, and the recess is located in a free edge of one of the parts of the angle iron.

4. The casket hardware of claim 3 wherein the bracket includes a flat portion slidable in the guide.

5. The casket hardware of claim 4 wherein the generally U-shape bracket includes two flat, spaced, parallel arms with an open end, the means on the bracket engaging the screw comprising aligned openings in the bracket arms adjacent the open end of the bracket.

6. The casket hardware of claim 5 wherein the angle iron is located between the bracket arms, the closed end of the bracket, and the screw.

7. The casket hardware of claim 6 including a second like recess in the free edge of the other part of the angle iron, said second recess receiving one of the arms of the bracket in a position of bracket and screw at about 90° to the said original position of the bracket on the angle iron.

8. The casket hardware of claim 7 wherein the dimension of the bracket between arms is equal to the distance from an outer surface of one angle iron part to the bottom of the recess in the other angle iron part.

9. The combination with a casket having bottom, side and end walls, and a flat ledge on an end wall, of an adjustable supporting device for a body supporting frame wherein the frame comprises elongated members forming sides and ends therefor, said members being interconnected fixedly and having one member adjacent to and generally parallel to the end wall of the casket having the ledge, a flat bracket on the ledge and extending inboard of the casket, a second bracket on the floor of the casket, aligned openings in the brackets, a bushing in each opening, an upright screw shaft held at its ends in the bushings, a third bracket comprising a two arm U-shaped member of flat stock having a closed end and an open end, aligned openings in the arms of the U-shape member, said screw shaft extending through the openings in the arms and threadingly engaging the edges of said arm openings, the member of the body supporting frame, that is adjacent to the end wall having the ledge, being located partially in the U-shape bracket between the arms thereof and between the closed end of the U-shape bracket and the screw shaft and extending transversely of the U-shape bracket and out of the sides thereof, said frame member partially located in the U-shape bracket being capable of linear adjustment motion between the U-shape bracket closed end and the screw shaft, and means to turn the screw shaft, the frame member that is located partially in the U-shape bracket being an angle iron comprising a horizontal flange and a vertical flange, the horizontal flange being located on the inner surface of one of the arms of the U-shape bracket, and the vertical flange engaging the inner surface of the other arm of the U-shape bracket.

a recess in the edge of the vertical flange of the angle iron, the said other arm of the U-shape being received therein.

10. The combination of claim 9 including a recess in the edge of the horizontal flange receiving one of said arms of the U-shape bracket when the screw shaft is disengaged from the bushings and turned to a position parallel with the body supporting frame.

11. The combination of claim 10 wherein the distance from the horizontal flange to the recess is equal to the distance between the arms of the U-shape bracket.

12. The combination of claim 10 wherein the distance between the arms of the U-shape bracket is equal to the distance from the vertical flange to the recess in the horizontal flange.

13. Casket hardware comprising a body supporting member in the form of a substantially fixed frame, means to support the frame at a portion thereof, means to adjust the frame supporting means to vary the vertical portion of at least a part of the frame at said portion of the frame, said adjusting means comprising a fixed position screw, a U-shaped bracket having two spaced arms, a closed end and an open end, means on the bracket adjacent the open end thereof engaging the screw arms and essentially closing the open end of the bracket, so that the bracket is translated along the screw as the screw rotates, said frame part being captured in the bracket between the screw and the closed end of the bracket and being capable of motion in the area of the bracket between the screw and the bracket closed end, but being prevented from motion at right angles to said motion, and means to so prevent said right angular motion, said means comprising a guide between the bracket and frame part, said guide including a recess in the frame part accomodating an arm of the bracket, the frame part being an angle iron and the recess being in an edge of a flange of the angle iron, and a second like recess in the edge of the other flange of the angle iron, said second recess receiving the bracket arm when frame is pivoted to about 90° from the original interrelated position of a bracket and frame whereby the frame and screw may be generally parallel or positioned at substantially right angles for use, with the interrelation of the frame and bracket relatively otherwise undisturbed.

14. Casket hardware of claim 13, wherein the dimension of the bracket between arms is equal to the distance from an outer surface of angle iron part to the bottom of the recess in the other angle iron part.

* * * * *